US007150689B2

(12) United States Patent
Balingit

(10) Patent No.: US 7,150,689 B2
(45) Date of Patent: Dec. 19, 2006

(54) PITCHING PRACTICE APPARATUS

(76) Inventor: Ronald F. Balingit, 6320 Meadow Haven Dr., Agoura Hills, CA (US) 91301

( * ) Notice: Subject to any disclaimer, the term of this patent is extended or adjusted under 35 U.S.C. 154(b) by 0 days.

(21) Appl. No.: 11/084,585

(22) Filed: Mar. 21, 2005

(65) Prior Publication Data

US 2006/0211524 A1 Sep. 21, 2006

(51) Int. Cl.
*A63B 69/00* (2006.01)
*A63B 69/40* (2006.01)

(52) U.S. Cl. ..... 473/451; 473/422; 124/16

(58) Field of Classification Search ..... 473/422, 473/431, 432, 451, 453–456; 124/6, 7, 16
See application file for complete search history.

(56) References Cited

U.S. PATENT DOCUMENTS 4,657,250 A * 4/1987 Newland et al. ..... 473/432
5,064,194 A * 11/1991 Bixler et al. ..... 473/436
D331,426 S * 12/1992 Riffle et al. ..... D21/780
5,511,775 A * 4/1996 Parks ..... 473/454
5,599,017 A * 2/1997 Bixler et al. ..... 473/436
5,711,726 A * 1/1998 Powers ..... 473/453
5,779,241 A * 7/1998 D'Costa et al. ..... 273/371
6,640,200 B1 * 10/2003 Baum ..... 702/142

* cited by examiner

*Primary Examiner*—Mitra Aryanpour

(57) ABSTRACT

A pitching practice apparatus for indicating if a desired ball speed has been attained or exceeded in a defined strike zone comprising a pivoted ball target assembly for absorbing energy from the ball, a spring for storing the absorbed energy, a ball speed indicator with a signal device and a chassis with cover panels. In operation, a pitched ball impacting the defined strike zone will transfer kinetic energy to the ball target assembly which will convert the energy to rotational kinetic energy. The rotational kinetic energy is then stored as elastic energy of the spring. The ball speed indicator with signal device will sense the deformation of the spring and will indicate if the desired the ball speed has been attained or exceeded by the raising of a flag. The desired ball speed can be set by the user. The apparatus can be made to essentially stop the ball after impact or to allow the ball to rebound.

1 Claim, 5 Drawing Sheets

PITCHING PRACTICE APPARATUS

BACKGROUND OF INVENTION

A. Field of Invention

This invention relates to pitching practice devices for indicating the location and the speed of a pitched ball, specifically to a pitching practice apparatus.

B. Description of Prior Art

In a game of baseball or softball, the ability of a pitcher to throw the ball at a desired speed through a desired location such as the strike zone is very important. Good pitching practice devices have been introduced into the prior art which can be used to improve that ability.

Pitching practice devices include the baseball hitting-pitching practicing device by Burns, Jr., (U.S. Pat. No. 6,695,725) which discloses a device for permitting a user to practice pitching a ball into a strike zone; the pitching practice device with adjustable strike zone indicator by Howard (U.S. Pat. No. 6,663,513) which discloses a device for indicating and simulating the height and width of a strike zone for a typical batter; the baseball and softball practicing device by McGrath (U.S. Pat. No. 6,458,048) which discloses a system for improving a ball player's skills which includes a target assembly for defining a passage therethrough for representing a zone for an accurately thrown ball to pass through; the practice device for a baseball pitcher by Majumdar (U.S. Pat. No. 6,837,809) which discloses a device which can be used to return the pitched ball to the pitcher at a location of choice; and the baseball pitching target by Walsh (U.S. Pat. No. 6,322,461) which discloses a baseball pitching target wherein a folded simulated batter figure, a swingable spring-loaded arm having a glove target at the other end and the necessary structure to support the elements are used. The device by Walsh is particularly different because it can provide a visual indication that a glove target simulating a catcher's mitt has been hit by the swinging of an arm on the end of which the glove target is connected. After the hit, the arm swings backward and automatically resets by means of a loaded spring or a bungee cord.

The devices can be used to determine if the pitched ball entered the strike zone, but, they cannot be used to indicate if the desired ball speed has been attained or exceeded.

The projectile impact locating device by Miller (U.S. Pat. No. 6,715,760) discloses a device for locating the positions of impact of projectiles as they strike a target by detecting the pressure or force delivered upon impact. The device can determine the magnitude of the impact force, but it cannot be used to determine the speed of the projectile because it cannot measure the average value of the impact force and the duration of impact, the parameters necessary to make a correlation between impulse and momentum.

The return net device by Nickerson (U.S. Pat. No. 6,620,064) discloses a portable return net device for receiving, arresting and returning a ball to a central location point for pitched, thrown or batted balls in a ball practice system. The device cannot be used to indicate if the desired ball speed has been attained or exceeded.

Prior art devices for indicating ball speed which require user-actuated electrical: switches include the pitching speed indicator by Calimeri (U.S. Pat. No. 5,163,014) which uses a manually-operated stopwatch and electronic equipment and the base trainer by Black, et el., (U.S. Pat. No. 5,566,934) which uses a foot-operated switch and electronic equipment. The accuracy of the ball speed indication of these devices depends on proper synchronization of ball release and actuation of the devices. Hence, people with poor physical dexterity cannot use the devices to obtain a good indication of ball speed.

Automatic devices for indicating ball speed include the speed measurement device with statistics gathering capability by Vermillion (U.S. Pat. No. 6,683,558) which uses radar waves and electronic equipment; the Doppler radar speed measuring unit by Cadotte, Jr., et al., (U.S. Pat. No. 6,091,355) which uses microwaves and electronic equipment; and the method and apparatus to determine golf ball trajectory and flight by Gobush, et al., (U.S. Pat. No. 6,764,412) which uses optics and electronic equipment. These devices use complex electronic equipment and can be damaged if a fast ball hits any of their components. The apparatus by Gobush, et al., is most susceptible to such damage because of the cameras and Fresnel lenses used.

There is no automatic device for indicating if the desired ball speed has been attained or exceeded in a defined strike zone which is purely mechanical in construction.

SUMMARY OF INVENTION

A. Objects and Advantages

Accordingly, the present invention will provide an apparatus for automatically indicating if the desired ball speed has been attained or exceeded in a defined strike zone that is purely mechanical in construction, which can be used as a pitching target by anyone and which is robust enough to absorb without damage the impact of a pitched ball.

The present invention will also provide an apparatus which is portable, which is simple to design and to manufacture, and which does not require good physical dexterity.

Further objects and advantages of the present invention will become apparent from a consideration of the ensuing drawings and description.

B. Description of Invention

This invention is an apparatus for automatically indicating if the desired ball speed has been attained or exceeded in a defined strike zone which comprises:

a chassis for providing structural support to the other elements;

a ball target assembly pivotably connected to the chassis for absorbing kinetic energy from a pitched ball wherein the ratio of the square of the moment of mass to the moment of inertia is minimized;

an energy storage mechanical device with one end fixedly connected to the chassis and the other end linkably connected to said ball target assembly for storing energy absorbed from the ball; and a ball speed indicator with a signal device for indicating if the desired ball speed has been attained or exceeded.

A small free travel gap between said ball target assembly and said energy storage mechanical device is provided to prevent said energy storage mechanical device from opposing the force of impact of the pitched ball.

Apparatus starts when a moving ball impacts the defined strike zone of said ball target assembly. Said ball target assembly will absorb the force of impact of the ball while the free travel gap will prevent said energy storage mechanical device from opposing the impact force. Some translational kinetic energy of the ball is converted to rotational kinetic energy of said ball target assembly. Rotational kinetic energy from said ball target assembly is transferred to said energy storage mechanical device when the free travel gap is reduced to zero. Said ball speed indicator will detect a change in a specific physical dimension of said energy storage mechanical device and from such detection indicate by means of said signal device if the desired ball ball speed has been attained or exceeded. The speed setting of said signal device can be adjusted by the user.

DETAILED DESCRIPTION OF INVENTION

A. BRIEF DESCRIPTION OF DRAWINGS

B. LIST OF REFERENCE NUMERALS

1—defined strike zone
2—target plate
3—shaft
4—pulley
5—scale flange
6—adjustment screw
7—trip lever
8—latch and trip bar
9—hanger
10—pin
11—flag
12—torsion spring
13—right side cover panel
14—leaf spring
15—bracket
16—left support pedestal
17—right support pedestal
18—tension spring
19—spring bracket
20—ball through
21—helical screw
22—base frame
23—self-aligning bearing
24—wire rope
25—opening for speed setting
26—chassis extension
27—safety barrier
28—frame
29—opening

C. DETAILED DESCRIPTION OF DRAWINGS

Figure 1:
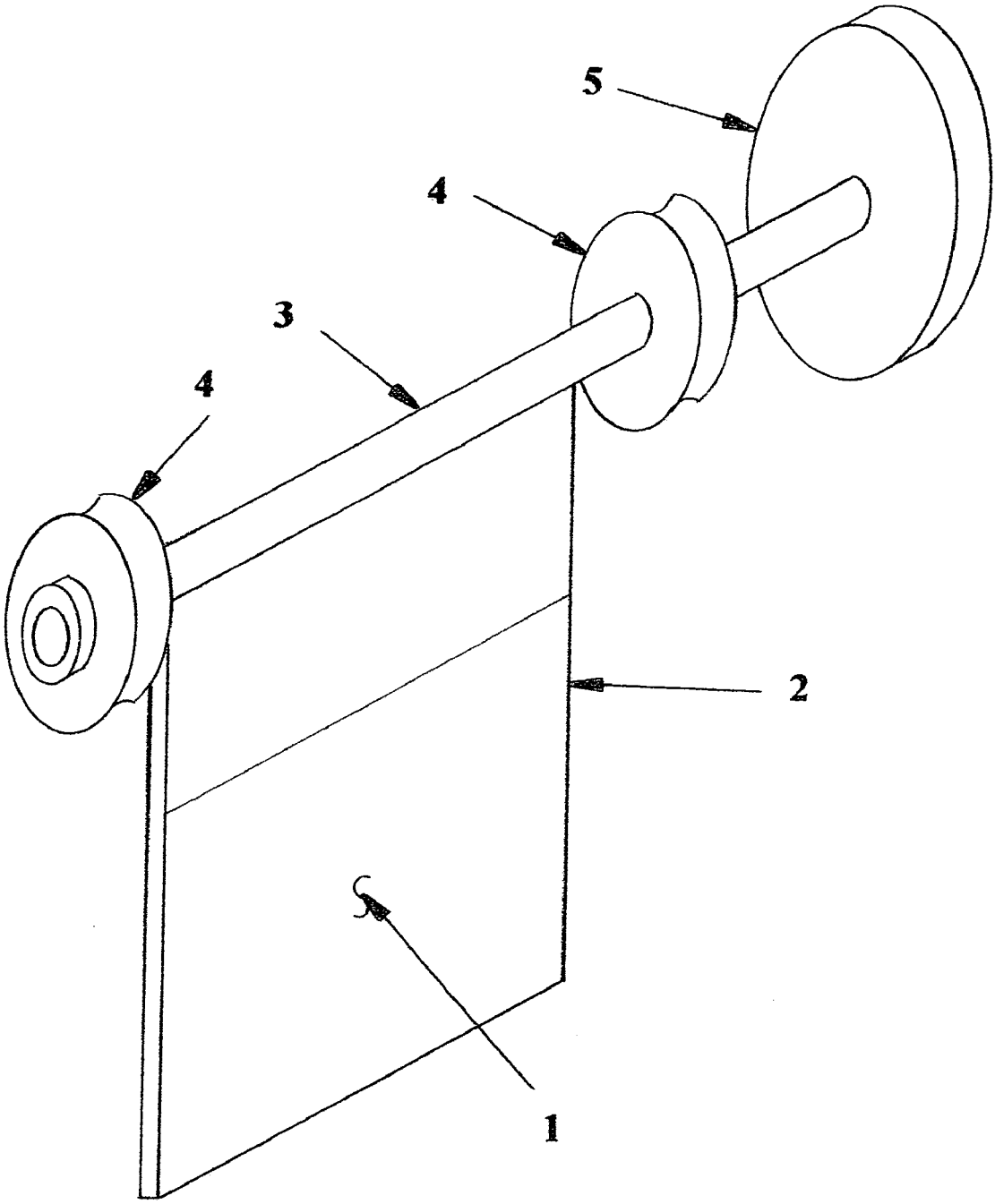
FIG. 1 is an isometric drawing of the preferred embodiment of a ball target assembly.

FIG. 1 is an isometric drawing of the preferred embodiment of a ball target assembly. The figure shows defined strike zone 1 on the front surface at the lower portion of target plate 2. Target plate 2 can be integral with shaft 3 as shown in the figure or can be bolted to a longitudinal flange (not shown) of shaft 3 to allow replacement of target plate 2, if desired. Pulley 4 and scale flange 5 can be integral with shaft 3 or fixedly connected by keys or set screws.

Figure 2:
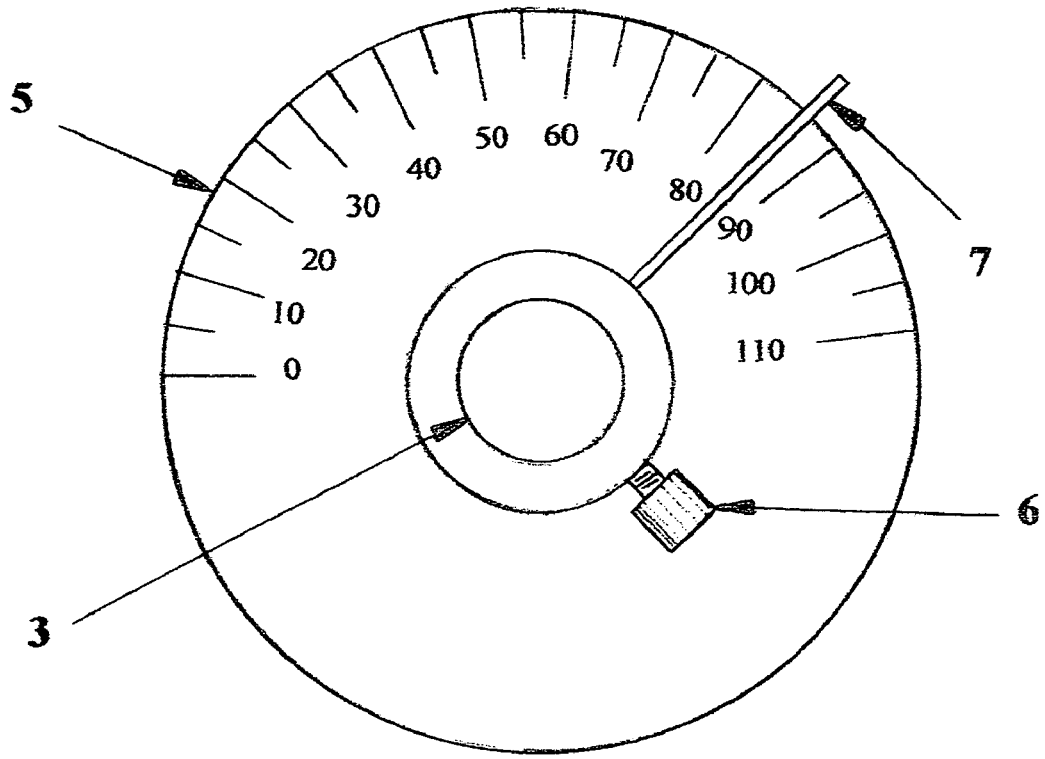
FIG. 2 is a side view of the preferred embodiment of a speed indicator.

FIG. 2 is a side view of the preferred embodiment of a speed indicator. The figure shows a typical uniformly spaced scale for adults mounted on the circular face of scale flange 5 coaxial with shaft 3. The speed setting can be adjusted by loosening adjustment screw 6 and moving trip lever 7 to the desired speed and retightening adjustment screw 6.

Figure 3:
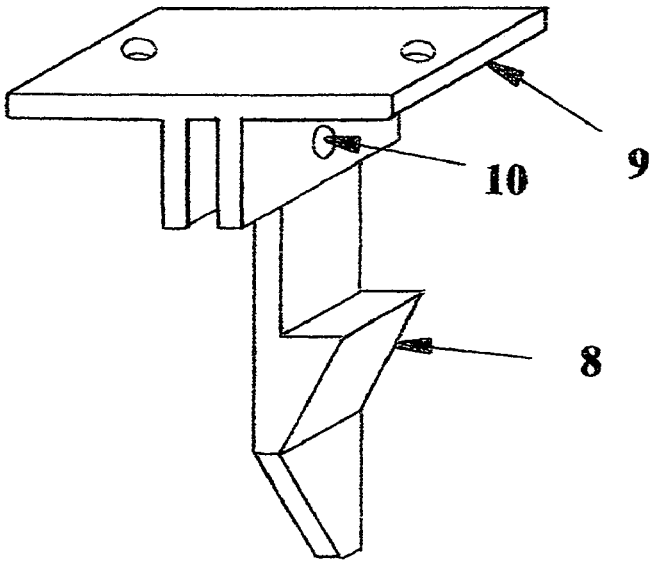
FIG. 3 is an isometric drawing of the preferred embodiment of a trip mechanism.

FIG. 3 is an isometric drawing of the preferred embodiment of a trip mechanism. The figure shows latch and trip bar 8 pivotably connected to hanger 9 by pin 10. Hanger 9 is fixedly connected to the top cover (not shown) of apparatus.

Figure 4:
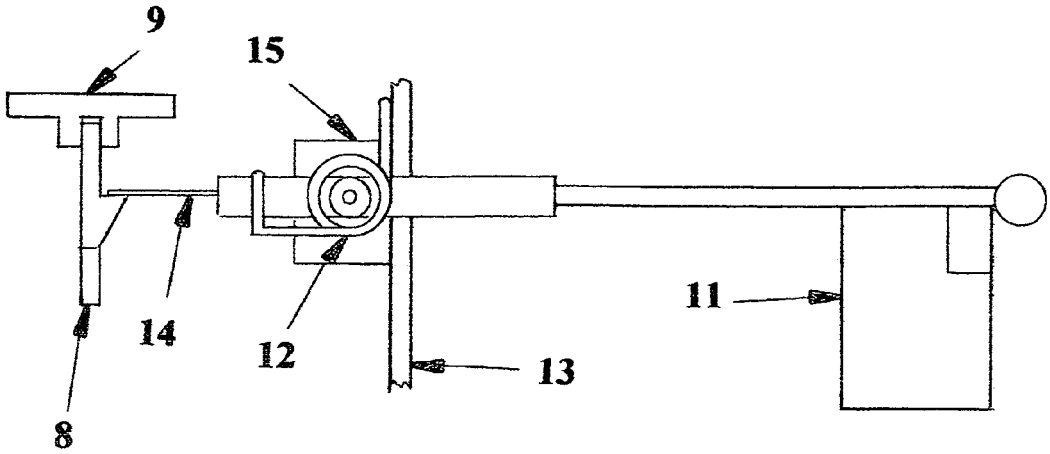
FIG. 4 is a front view of the preferred embodiment of a signal device without a trip lever.

FIG. 4 is a front view of the preferred embodiment of a signal device without a trip lever. The figure shows flag 11 connected to a pivoted pole with leaf spring 14 fixedly connected to the other end of the pole. The pole pivot is connected to bracket 15. Torsion spring 12 is positioned so as to urge the pole to move to the erect position by pushing one end of torsion spring 12 against right side cover panel 13, a section of which is shown. Signal device is set by rotating the pole in the clockwise direction forcing leaf spring 14 to overcome the inclined surface of latch and trip bar 8 and to latch as shown in the figure.

Figure 5:
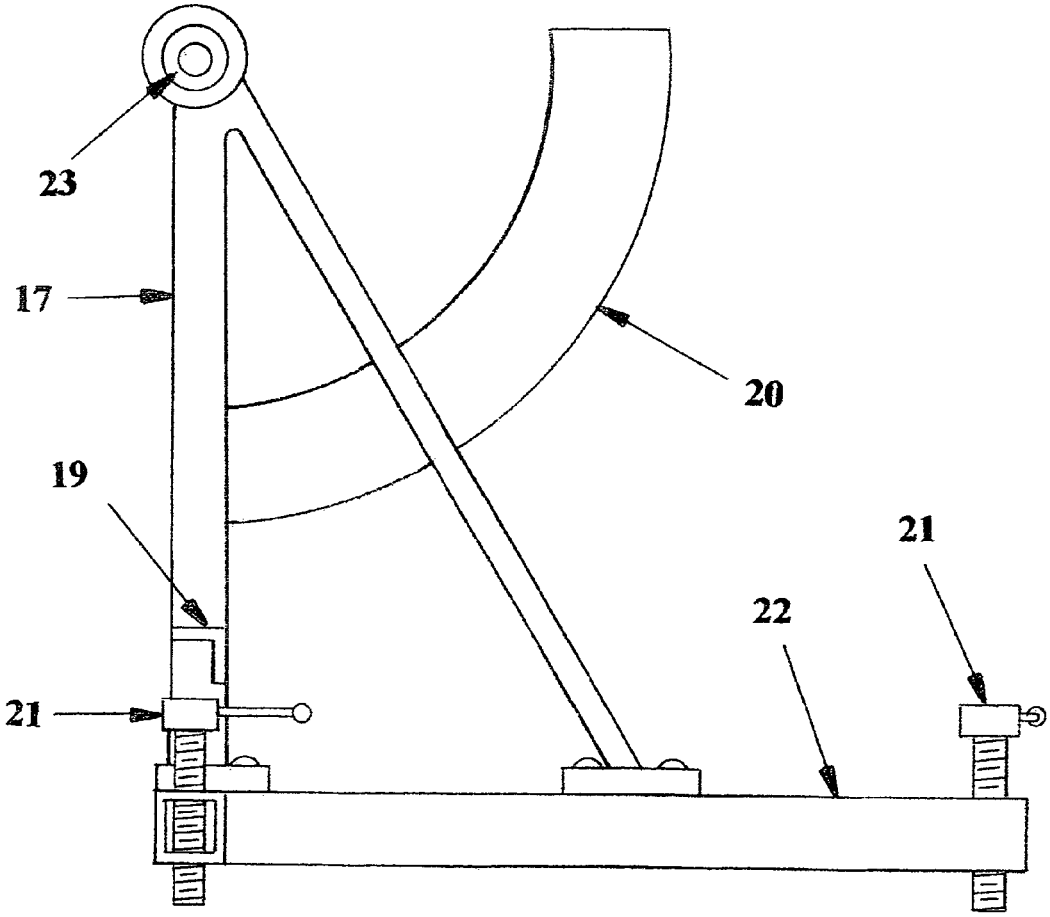
FIG. 5 is a right side view of a portion of a chassis.

FIG. 5 is a right side view of a portion of a chassis showing right support pedestal 17 bolted to base frame 22. Self-aligning bearing 23 is inside a hub at the top of right support pedestal 17. A similar bearing arrangement is used for left support pedestal 16 shown in FIG. 6. Spring bracket 19 is integral with the right support pedestal 17. Helical screw 21 is for leveling and anchoring apparatus. Ball through 20 is for collecting balls pitched into defined strike zone 1 that enter apparatus.

Figure 6:
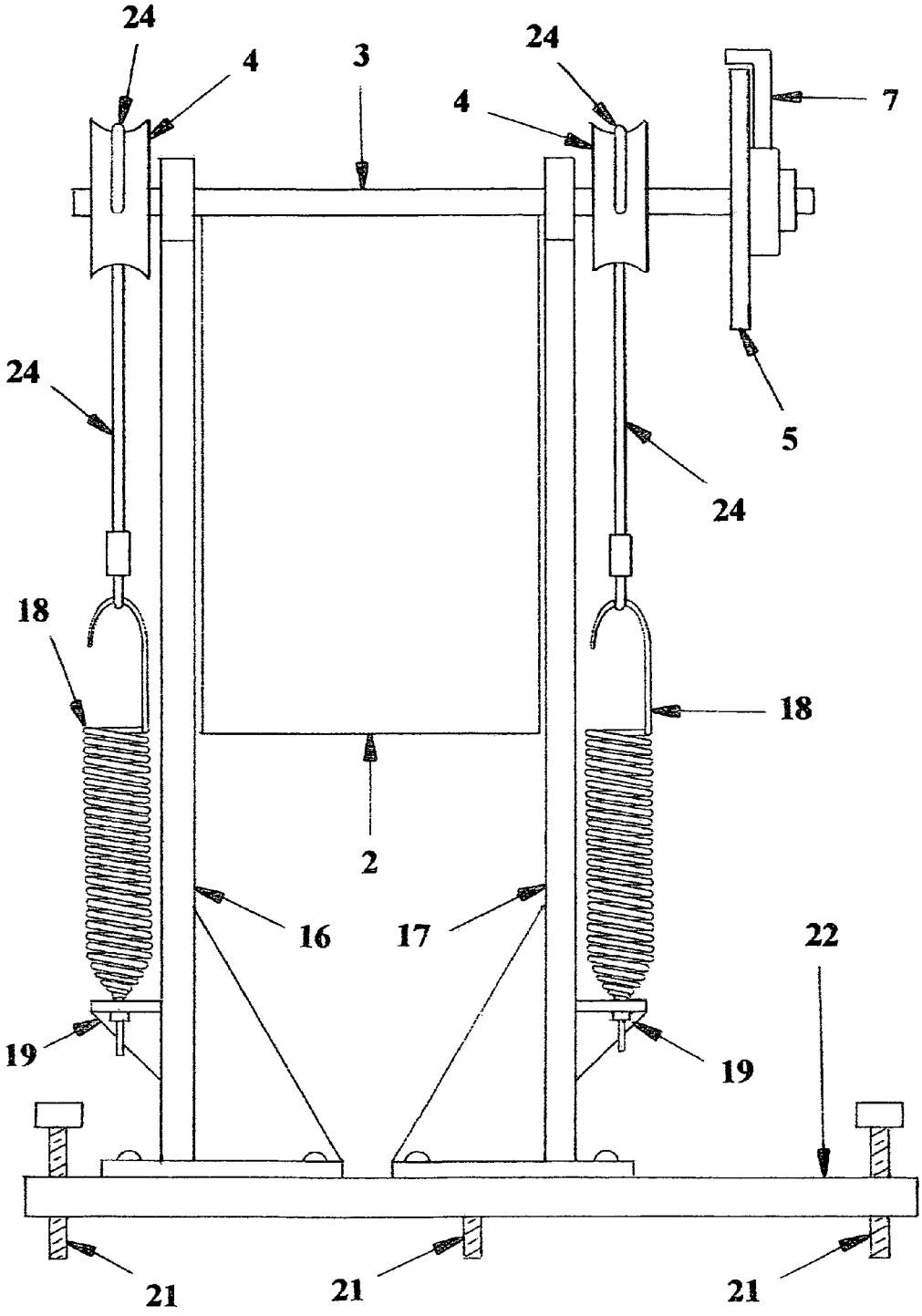
FIG. 6 is a front view of apparatus with a trip lever and without a cover panel.

FIG. 6 is a front view of apparatus with a trip lever and without a cover panel. The figure shows the lower end of tension spring 18 connected to spring bracket 19 by an adjustable bolt and the upper end connected to wire rope 24. The other end of wire rope 24 is partially wrap around and fixedly connected to pulley 4 in such a way that tension spring 18 will be stretched when target plate 2 is pushed backwards. An initial slack of wire rope 24 is provided to allow a small amount of free travel of target plate 2 before tension spring 18 is stretched. When the ball speed is equal or greater than the setting of trip lever 7, trip lever 7 will push latch and trip bar 8 in the transverse direction disengaging leaf spring 14 from latch and trip bar 8 thereby allowing torsion spring 12 to rotate the pole and flag 11 shown in FIG. 4 to the erect position. Thus signaling the user that the set speed has been attained or exceeded. Latch and trip bar 8 will reset by gravity.

Figure 7:
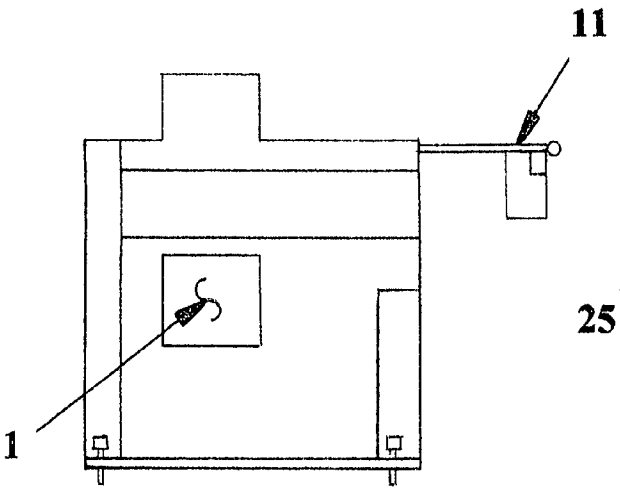
FIG. 7 is a front view of apparatus with cover panel.

FIG. 7 is a front view of apparatus with cover panel showing defined strike zone 1 and flag 11. Foam rubber (not shown) can be glued on the back of the cover panel facing target plate 2 to cushion the return of said ball target assembly to the initial position caused by the urging of tension spring 18.

Figure 8:
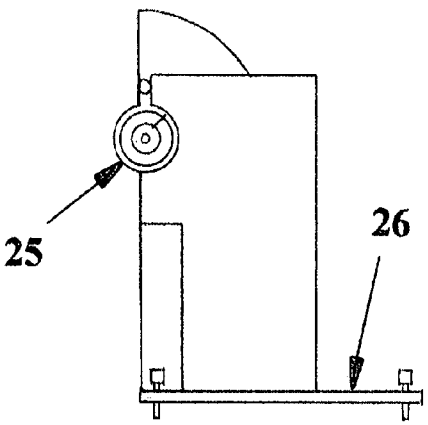
FIG. 8 is a right side view of apparatus with cover panel.

FIG. 8 is a right side view of apparatus with cover panel showing opening for speed setting 25 for access to adjustment screw 6 and trip lever 7 shown in FIG. 2.

Figure 9:
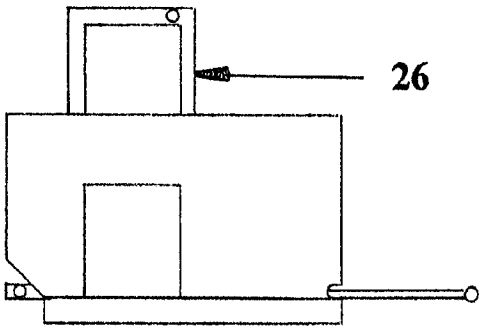
FIG. 9 is a top view of apparatus with cover panels

FIG. 9 is a top view of apparatus with cover panel showing chassis extension 26 to improve the stability of apparatus.

Figure 10:
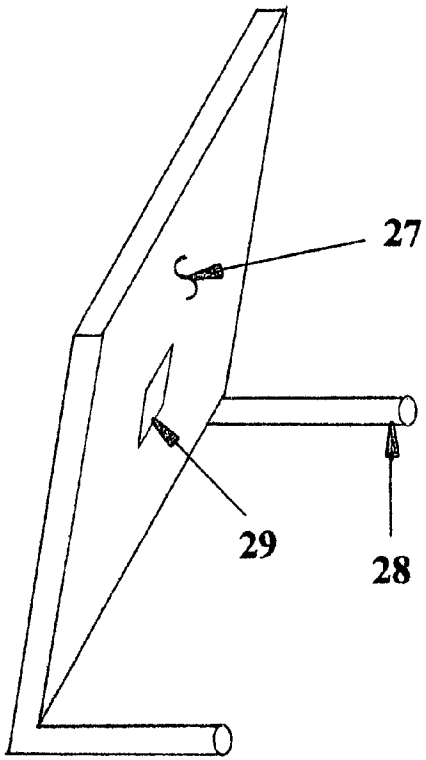
FIG. 10 is an isometric drawing of a suggested safety barrier.

FIG. 10 is an isometric drawing of a suggested safety barrier to be positioned in front of apparatus to primarily stop errantly pitched balls. Frame 28 should be properly anchored. Safety barrier 27 should have a small forward tilt and should be made of a durable net or reinforced canvas. Opening 29 should be placed in front of defined strike zone 1.

D. LIST OF SYMBOLS AND ABBREVIATIONS

C—a constant
dm—infinitesimal element of mass
Δ h—change in elevation of center of gravity
Δ p.e.—change in gravitational potential energy
$e_o$—energy efficiency of impact
$e_T$—efficiency of energy transfer from ball target assembly to tension spring
$E_S$—elastic energy stored in the tension spring
g—acceleration due to gravity
—moment of inertia of pivoted mass about the pivot
$K_S$—tension spring constant
$K_T$—equivalent torsion spring constant of the tension spring
m—mass of the ball
M—moment of mass of the pivoted mass about the pivot
$m_R$—mass of reference ball
$m_T$—mass of pivoted mass
θ—angular displacement
r—radial distance of infinitesimal element of mass to pivot
R—radius of pulley
∫—integral sign
u—initial speed of the ball
v—speed of rebound of the ball
$v_R$—speed of reference ball
ω—angular speed of pivoted mass
x—deformation of tension spring E. Scientific Basis In the inelastic collision between two bodies wherein the bodies separate after impact, there are several possible outcomes. The outcomes depend on the initial velocities and the inertial properties of the bodies and the inelasticity of impact.

The inelastic collision between two bodies such as a baseball and a stationary mass pivoted at one of its edges can be grouped into three possible outcomes for the ball:

Outcome A: the ball essentially stops after impact,

Outcome B: the ball rebounds to the opposite direction, and

Outcome C: the ball moves in the same direction but at a lower speed.

Analysis for Outcome A Applicable to the Present Invention:

If the ball essentially stops after impact, then almost all its translational kinetic energy will be absorbed and converted to rotational kinetic energy of the pivoted mass. Some kinetic energy will be lost because the collision is inelastic, however, momentum will be conserved. Absorbing almost all of the translational kinetic energy of the ball will have the advantage of having a bigger reservoir of energy to take measurements from. Any change in gravitational potential energy of the pivoted mass will be considered in the design of an apparatus for the present invention and for the sake of simplicity will not be considered in the following analysis. By proceeding in this manner, a simple correlation between the initial speed of the ball and a property change in the present invention can be established.

Please refer to List of Symbols and Abbreviations for the definitions of the symbols and abbreviations used from hereon.

From the law of conservation of momentum:

$$m\,u = M\,\omega \tag{1}$$

From the law of conservation of energy:

$$e_0(0.5\ m\ u^2) = 0.5\ I\ \omega^2 \tag{2}$$

Note that the location of the point of impact did not enter into equations (1) and (2). This means the amount of kinetic energy absorbed by the pivoted mass is essentially independent of the point of impact. Impulse is the product of the average impact force and the duration of impact. Because the momentum of the ball will be converted to impulse at impact, it can be shown that the impact force will be greater and the duration of impact will be shorter if the point of impact is closer to the pivot. If the point of impact is further from the pivot the reverse will occur.

The value of "$e_0$", the energy efficiency of impact, could decrease depending on the magnitude of the impact force. For the sake of simplicity in the analysis, $e_0$ will be assumed to be constant.

Dividing equation (2) by equation (1) and simplifying:

$$e_0\ u = (I/M)\ \omega \tag{3}$$

Substituting the value of "u" from equation (1) into equation (3) and simplifying:

$$m = (M^2/I)\ e_0 \tag{4}$$

Equation (4) must be satisfied to stop the ball after impact and to transfer most of the bail's kinetic energy to the pivoted mass "$m_T$". Equation (4) shows the ratio $M^2/I$, a property of the pivoted mass, is slightly greater than the mass of the ball. The ratio has the unit of mass and can be interpreted as the equivalent mass of the pivoted mass during impact, it is not identical to the gravitational mass. This is very important to note because it means as long as the ratio is satisfied the pivoted mass can be heavier than the ball.

The ratio $M^2/I$ must be minimized in order to maximize the mass of the pivoted mass that can be used to essentially stop the ball after impact.

M, the moment of mass, is defined by integrating the moment of all the infinitesimal elements of the mass about the pivot:

$$M = \int r\ dm \tag{5}$$

I, the moment of inertia of mass, is defined by integrating the second order moment of all the infinitesimal elements of the mass about the pivot:

$$I = \int r^2\ dm \tag{6}$$

The ratio $M^2/I$ depends on the distribution of the mass with respect to the pivot or axis of rotation. If mass is moved closer to the pivot so as to form a cylindrical solid coaxial with the pivot, it can be shown that the ratio is $8\ m_T/9$. If mass is moved away from the pivot, it can be shown that the ratio will reach a relative minimum then increase as mass is moved further from the pivot approaching a maximum value of $m_T$ when all the mass is so far from the pivot that it can be considered a point mass. The relative minimum value of the ratio occurs when the mass is formed into a thin rectangular plate pivoted about an axis parallel to one of its sides wherein the axis is inside or on the rectangular plate. The relative minimum value is $3\ m_T/4$.

The fact that the strike zone is almost a rectangle is very fortuitous for the present invention!

If the pivoted mass is now called a ball target assembly of the present invention then the following will apply.

The ratio $M^2/I$, a property of said ball target assembly, must be controlled to essentially stop the ball or to minimize ball rebound after impact.

The ball that will essentially stop after impact will be called the reference ball. The reference ball can be one of the common game balls such as baseball, softball or children's balls.

A reference ball heavier than the common game balls can be used. One advantage of using a heavier reference ball is it will allow the use of a heavier ball target assembly. Another advantage of using a heavier reference ball is it will exercise and strengthen the pitching arm, hand and fingers of the pitcher.

The relationship between the reference ball and another ball having the same momentum is:

$$m_R\, v_R = m\, u$$

or, $$u=(m_R/m)\, v_R \tag{7}$$

And for the reference ball and another ball having the same kinetic energy is:

$$0.5\, m_R(v_R)^2=0.5 m\, u^2$$

or, $$u=(m_R/m)^{0.5}\, V_R \tag{8}$$

Equations (7) and (8) can be used to calculate the multipliers in the scale of said ball speed indicator to indicate the equivalent speeds as if the other ball was pitched.

Three scales can be used: one for the speed of the reference ball, another for the equivalent speed of the other ball with equal momentum and a third for the equivalent speed of the other ball with equal kinetic energy. The scales can be made on one piece of the indicator face, or, in order to avoid confusion in reading the scales, made on three separate pieces of indicator face that can easily be interchanged, if desired by the user.

The preferred embodiment of said energy storage mechanical device is a tension spring with one end fixedly connected to said support chassis and the other end connected by a small wire rope to a pulley fixedly connected to the shaft of said ball target assembly. The end of the spring connected to said support chassis will have an adjustment for spring tension.

The energy stored in a tension spring without exceeding the elastic limit of the spring material is:

$$E_S=0.5\, K_S\, x^2$$

The deformation of the spring "x" can be represented by:

$$x=R\,\theta$$

Hence: $E_S=0.5\, K_S\, R^2\, \theta^2$

Since $K_S$ and R are constants, putting $K_T=K_S\, R^2$:

$$E_S=K_T\,\theta^2 \tag{9}$$

Note the similarity of this equation with the elastic energy stored in a torsion spring. This means a torsion spring can be used for said energy storage mechanical device with the same results. "$K_T$" will be called the equivalent torsion spring constant.

Because the reference ball will essentially stop after impact, almost all translational kinetic energy of the ball will be converted to rotational kinetic energy of said ball target assembly. A small amount of energy will be lost due to the inelastic impact. Equation (2) shows the relationship between the two energies.

Most of the rotational kinetic energy of said ball target assembly is converted to the elastic energy stored in the tension spring. A small amount of energy will be lost due to friction and air resistance.

Hence: $e_T(0.5\, I\, \omega^2)=0.5\, K_T\, \theta^2$

Using equation (2) and the above equation the sought after relationship between the speed of the reference ball and a specific physical property change of an energy storage mechanical device of the present invention can easily be derived:

$$\theta=(e_0\, e_T\, m/K_T)^{0.5}\, u \tag{10}$$

Since all the terms inside the parenthesis are constants, equation (10) shows a simple proportional relationship between the angular displacement and the speed of the reference ball.

Analysis for Outcome B Applicable to the Present Invention:

In outcome B the ball rebounds after impact.

From the Law of Conservation of Momentum:

$$m\, u=M\, \omega-m\, v$$

Momentum being a vector, the negative sign before "m v" indicates the ball rebounds in the opposite direction.

Simplifying the equation:

$$M\, \omega=m(u+v) \tag{11}$$

From the Law of Conservation of Energy:

$$e_0(m\, u^2/2-m\, v^2/2)=I\, \omega^2/2$$

Simplifying the equation:

$$I\, \omega^2=e_0\, m(u+v)(u-v) \tag{12}$$

Squaring equation (11) and dividing with equation (12):

$$M^2/I=m(u+v)/e_0(u-v) \tag{13}$$

For a thin rectangular plate of mass $m_T$, it can be shown that:

$$M^2/I=3\, m_T/4 \tag{14}$$

Putting $(M^2\, e_0/I\, m)=C$ and solving equation (13) for "v" the speed of ball rebound:

$$v=u(C-1)/(C+1) \tag{15}$$

The relationship between the translational kinetic energy lost by the ball and the tension spring can be represented by:

$$e_0\, e_T\, m(u^2-v^2)=K_T\,\theta^2 \tag{16}$$

By combining equations (15) and (16) to eliminate "v", the relationship between the angular displacement "θ" and the initial ball speed "u" can be obtained:

$$\theta=\{e_0\, e_T\, m[1-(C-1)^2/(C+1)^2]/K_T\}^{0.5}\, u \tag{17}$$

Equation (17) shows the proportional relationship between θ and u.

An analysis for outcome C wherein the ball continues to move in the same direction after impact will not be provided because it will become obvious from the following example designs that for such outcome to occur the mass "$m_T$" must be less than the mass of the ball which is already small.

For outcomes A and B the constant of proportionality between θ and u can be determined experimentally by measuring the angular displacement corresponding to known ball speeds. The constant of proportionality can also be estimated by assuming values for the two efficiencies, $e_0$ and $e_T$.

EXAMPLE DESIGNS OF INVENTION

A. Pitching Practice Apparatus for Children

Case I:

With the use of a safety barrier to stop errantly thrown balls, the child user should be able to stand close to said apparatus. Hence a smaller strike zone can be defined.

Because some children could be exceptionally strong, a maximum ball speed of 60 miles per hour (mph) will be used in the example design. The value of $M^2/I$ of ball target assembly should be minimized. The strike zone defined on the rectangular plate of ball target assembly is a square one foot on each side.

Summary of Assumptions:

reference ball is a baseball weighing 5 ounces, mass of $9.705*10^{-3}$ slug maximum ball speed is 60 mph or 88 feet per second (fps)

baseball essentially stops after impact target plate of ball target assembly 1 foot by 16 inches with a uniform thickness strike zone is a square 1 foot on each side two tension springs embody energy storage mechanical device maximum angular displacement of ball target assembly, also the maximum angular displacement of the pulleys of the tension springs is 180 degrees or π radians $e_0$=95%

$e_0$ $e_T$=92%

Calculations using the absolute English system of units.

From equations (4) and (14) the mass of ball target assembly can be computed:

$$m_T=7 \text{ ounces or } 1.362*10^{-2} \text{ slug}$$

A light strong material such as plastic or carbon fiber can be used for said ball target assembly.

The translational kinetic energy of the ball is:

$$0.5 \text{ m } u^2=37.6 \text{ ft-lbs}$$

The increase in gravitational potential energy of said ball target assembly after rotating 180 degrees is approximately:

$$\Delta \text{ p. e.}=mg\ \Delta h$$

$$\Delta \text{ p. e.}=0.59 \text{ ft-lbs}$$

This is 1.6% of the energy of the ball. It is therefore small compared with the effect of $e_0$ which is assumed, hence it can be neglected.

Although one tension spring will suffice, using two smaller identical tension springs will improve symmetry and will minimize twisting of ball target assembly.

The equivalent torsion spring constant $K_T$ can be calculated from equation (10):

$$K_T=3.5 \text{ lb-ft/radian}$$

or $$K_T=0.061 \text{ lb-ft/degree of angular deformation}$$

Summarizing the design of a pitching practice apparatus for children:

baseball is used maximum pitching speed is 60 mph strike zone is 1 foot by 1 foot defined on the surface of a target plate of ball target assembly 1 foot by 16 inches of uniform thickness ball target assembly weighs 7 ounces maximum angular displacement of ball target assembly is 180 degrees two tension springs each with an equivalent torsion spring constant of 3.5 lb-ft/radian Using the same amount of mass, if it is desired to strengthen said ball target assembly by reducing the size of the strike zone to say 10 inches by 10 inches the other design parameters above will still apply.

Case II:

If it is desired to strengthen said ball target assembly by using more material thereby increasing the mass by a factor, then the values of M, I and $M^2/I$ will increase. To minimize ball rebound, it will be necessary to minimize the value of $M^2/I$.

There are two options in the design: one is to use a reference ball heavier than baseball that will essentially stop after impact and the other is to still use a baseball and to consider the rebound of the ball after impact. An example design for the second option is shown in the following example design of a pitching practice apparatus for adults.

Calculations for the first option is provided below using the same values and the same equations as in Case I except the weight of ball target assembly which is assumed to increase to one pound.

Using equations (4) and (14) the mass of the required reference ball that will essentially stop after impact is:

$$m_R=2.213*10^{-2} \text{ slug or } 11.4 \text{ ounces}$$

The result illustrates the importance of minimizing the weight of ball target assembly.

Using equation (8) the maximum speed of a reference ball having the same kinetic energy as a baseball moving at 60 mph is:

$$v_R=39.7 \text{ mph}$$

Since the amount of energy to be stored in the tension springs will not change, the equivalent torsion spring constant will not change.

B. Pitching Practice Apparatus for Adults

In the design of a pitching practice apparatus for adults the requirements are different. The target plate must be able to withstand the impact of the baseball which could be moving at speeds close to 100 mph. The size of the strike zone defined on the rectangular plate seen by the user must be large enough to simulate actual game conditions. Therefore, said ball target assembly will be much heavier than the ball and ball rebound must be considered in the design. Nevertheless, ball rebound should still be minimized by minimizing the value of $M^2/I$.

Summary of Assumptions:

m=5 ounces or $9.705*10^{-3}$ slug u=105 mph or 154 fps strike zone is a square 18 inches on each side defined on the surface of target plate of ball target assembly 18 inches by 22 inches ball target assembly weighs 2 pounds $e_0$=95%

$e_0$ $e_T$=92%

Maximum angular displacement of ball target assembly is 180 degrees or π radians Calculations using the absolute English system of units.

Using equations (14) and (15) the speed of the ball after impact is:

$$v=98.6 \text{ fps or } 67.2 \text{ mph}$$

The ball rebounds as if it was hit by a batter The decrease in speed is about 36%.

Using equation (16) and θ equals π, the equivalent torsion spring constant is:

$$K_T=6.33 \text{ lb-ft/radian or } 0.11 \text{ lb-ft/degree of angular deformation}$$

Summarizing the design of a pitching practice apparatus for adults:

ball is baseball weighing 5 ounces maximum ball speed is 105 mph or 154 fps strike zone is a square 18 inches on each side defined on the surface of target plate of ball target assembly 18 inches by 22 inches of uniform thickness.

ball target assembly weighs 2 pounds maximum angular displacement of ball target assembly is 180 degrees or π radians two tension springs, equivalent torsion spring constant of 6.33 lb-ft/radian In the actual design of apparatuses for children and adults the effect of the other components of ball target assembly such as shaft 3, pulley 4 and scale flange 6 should be considered in the calculation of the ratio $M^2I$ to determine the appropriate thickness of target plate.

OTHER CONSIDERATIONS OF INVENTION

A. Development and Calibration of Indicator Scale

The indicator scale can be developed by using equation (10) if the ball essentially stops after impact or by using equation (17) if the ball rebounds after impact.

One method of calibrating the indicator scale is by means of a specially-built spring actuated baseball gun wherein the muzzle speed of the ball can be adjusted by varying the deformation of a compression spring. The speed of the ball "u" can be calculated from:

$$0.5(m+m_S/3)u^2=0.5\ k\ x^2$$

where: m is the mass of the ball $m_S$ is the mass of the spring k is the compression spring constant x is the deformation of the compression spring B. Colored Indicator Scale To make it easier for the user to visually read the indicator scale, the interval between the main divisions of the indicator scale can be made of different colors, for example the colors of the rainbow. The interval between "0" and "10" could be red, orange between "10" and "20", yellow between "20" and "30" and so on.

C. Materials

To reduce weight of apparatus especially the ball target assembly whose weight must be minimized, light materials such as plastics and carbon fiber should be used whenever possible. The front cover panel should be made of robust material that can absorb without damage the impact of the ball. Suggested materials include plywood, steel and reinforced plastic.

SUMMARY, RAMIFICATIONS AND SCOPE

Accordingly, the present invention will introduce a new apparatus into the prior art to automatically indicate ball speed in a defined strike zone which is purely mechanical in construction and which is robust enough to absorb without damage the impact of a pitched ball. The present invention will also introduce an apparatus which is portable, which is simple to design and to manufacture and which does not require good physical dexterity to operate. An apparatus the use of which can be enjoyed by users.

The choice of tension spring to store energy was made to be able to make a simple correlation between the speed of the ball and a physical property change in the present invention. As explained with equation (9), a torsion spring can also be used.

Although the description above contains many specificities, these should not be construed as limiting the scope of the present invention but as merely providing illustrations of some of the presently preferred embodiments of this invention. For example, with the use of mechanical devices such as linkages, cams and gears other energy storage devices can be used. Other energy storage devices which are purely mechanical m nature and which can also be used in the present invention include compression springs, leaf springs, compressed gas and liquid columns.

A sliding ball target assembly can also be used in the present invention with the necessary equations which can be derived.

A return delay mechanism can also be used to stop the indicator scale for a few seconds to allow the user to read the scale. Such return delay mechanism can use a pendulum as the timer device or an electronic timer.

Also, while it is recommended to minimize the ratio $M^2/I$ of a said ball target assembly to maximize the amount of mass that can be used, the ratio need not be minimized if a higher speed of ball rebound is acceptable or desired. In addition, if ball rebound is acceptable or desired, the small free travel gap between said ball target assembly and said energy storage mechanical device can be eliminated Thus the scope of the present invention should be determined by the appended claims and their legal equivalents, rather than the examples given.

What is claimed is:

1. A pitching practice apparatus comprising:

a chassis including a bottom horizontal generally rectangular base frame positioned near ground level, said base frame having a forward end and sideward ends, two forward vertical substantially identical support pedestals attached to the forward end of said base frame and spaced sidewardly from each other with self-aligning bearings that are coaxial with one another near the top of said support pedestals, a front cover panel attached to said support pedestals having a rectangular opening between said support pedestals, side cover panels attached to said base frame and said front cover panel, and a top cover panel attached to said front cover panel and said side cover panels;

a ball target assembly including a rectangular target plate attached lengthwise to an intermediate section of a shaft along a shorter side of said target plate, said shaft slidingly connected to and coaxial with said self-aligning bearings such that said target plate is free to swing between said support pedestals and through the rectangular opening of said front cover panel, wherein the ratio of the square of the moment of mass to the moment of inertia about the axis of rotation equals the minimum possible value after satisfying structural strength requirements;

a plurality of tension springs wherein one end of each tension spring is fixedly connected to a corresponding spring bracket attached to a corresponding side of said support pedestals away from said target plate and an opposite end linkably connected to said shaft of said ball target assembly through a pulley and wire rope combination such that a small free travel gap is provided between said ball target assembly and said plurality of tension springs so as to prevent said plurality of tension springs from opposing the force caused by a ball; and a ball speed indicator including a scale flange coaxial with and fixedly connected near one end of said shaft of said ball target assembly, a trip lever slidingly connected to said scale flange such that the position of said trip lever can be adjusted with reference to said scale flange so that the user can adjust the setting to the desired ball speed, a latch and trip bar pivotably connected to a hanger attached to said top cover panel of said chassis such that said latch and trip bar is free to swing on a plane perpendicular to the axis of said scale flange and positioned so as to engage with said trip lever when a desired ball speed has been attained or exceeded, a signal device pivotably connected to one of said side cover panels of said chassis and positioned to allow said signal device to latch on to the latch surface of said latch and trip bar, said signal device having a pole, a leaf spring fixedly connected to one end of said pole, a flag fastened near an opposite end of said pole, with a pivot located between said flag and said leaf spring, and a coil spring with one end fixedly connected to one of said side cover panels of said chassis and an opposite end pivotably connected to said pole so as to urge said pole to raise said flag by rotating said pole towards the vertical position.

* * * * *